US010231584B2

(12) United States Patent
Kim et al.

(10) Patent No.: US 10,231,584 B2
(45) Date of Patent: Mar. 19, 2019

(54) CLEANER

(71) Applicant: LG ELECTRONICS INC., Seoul (KR)

(72) Inventors: Sungjun Kim, Seoul (KR); Donghoon Kwak, Seoul (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 15/444,611

(22) Filed: Feb. 28, 2017

(65) Prior Publication Data

US 2017/0332854 A1 Nov. 23, 2017

(30) Foreign Application Priority Data

May 17, 2016 (KR) ..... 10-2016-0060445

(51) Int. Cl.
*A47L 5/36* (2006.01)
*A47L 9/14* (2006.01)
(Continued)

(52) U.S. Cl.
CPC ..... *A47L 5/362* (2013.01); *A47L 9/009* (2013.01); *A47L 9/149* (2013.01); *A47L 9/244* (2013.01);
(Continued)

(58) Field of Classification Search
CPC ..... A47L 5/362; A47L 9/009; A47L 9/149; A47L 9/244; A47L 9/2852; A47L 9/2857; A47L 9/2884; A47L 9/327
See application file for complete search history.

(56) References Cited

U.S. PATENT DOCUMENTS

2004/0034952 A1* 2/2004 Ho ..... A47L 11/22 15/48.1
2005/0159268 A1* 7/2005 Yan ..... A47L 9/009 475/343

(Continued)

FOREIGN PATENT DOCUMENTS

EP 2865311 4/2015
JP 2012239582 12/2012

(Continued)

OTHER PUBLICATIONS

Extended European Search Report in European Application No. 17158102.8, dated Oct. 17, 2017, 7 pages (with English translation).

*Primary Examiner* — Dung Van Nguyen
(74) *Attorney, Agent, or Firm* — Fish & Richardson P.C.

(57) ABSTRACT

A cleaner that includes: a main body; a suction assembly; and a coupling hose, wherein the main body includes: an air suctioning device, a case, a driving motor that is coupled to a first surface of the case and that is configured to generate driving force, a traveling wheel that is coupled to the first surface of the case and that is configured to rotate based on driving force generated by the driving motor, a motor cover that is configured to cover the driving motor such that the driving motor is located in a space between the first surface of the case and the motor cover, a rotating shaft that is coupled to the driving motor and that is configured to transfer driving force generated by the driving motor to the traveling wheel, and a coupling unit that couples the rotating shaft to the traveling wheel is disclosed.

19 Claims, 14 Drawing Sheets

(51) Int. Cl.

| | |
|---|---|
| ***A47L 9/00*** | (2006.01) |
| ***A47L 9/24*** | (2006.01) |
| ***A47L 9/32*** | (2006.01) |
| ***A47L 9/28*** | (2006.01) |

(52) U.S. Cl.
CPC ..... *A47L 9/2852* (2013.01); *A47L 9/2857* (2013.01); *A47L 9/2884* (2013.01); *A47L 9/2894* (2013.01); *A47L 9/327* (2013.01)

(56) References Cited

U.S. PATENT DOCUMENTS

| | | | | |
|---|---|---|---|---|
| 2012/0181099 | A1* | 7/2012 | Moon | A47L 9/009 180/65.51 |
| 2013/0056290 | A1* | 3/2013 | Lee | A47L 9/009 180/65.6 |
| 2015/0114155 | A1* | 4/2015 | Park | A47L 9/009 74/405 |

FOREIGN PATENT DOCUMENTS

| | | |
|---|---|---|
| KR | 100876695 | 12/2008 |
| KR | 10-2011-0108758 | 10/2011 |
| KR | 10-2012-0118643 | 10/2012 |
| KR | 10-2015-0048488 | 5/2015 |
| WO | 2008/117945 | 10/2008 |
| WO | 2008/136575 | 11/2008 |

* cited by examiner

CLEANER

CROSS-REFERENCE TO RELATED APPLICATION

This application claims the priority benefit of Korean Patent Application No. 10-2016-0060445, filed on May 17, 2016 in the Korean Intellectual Property Office, the entire content of which is incorporated herein by reference.

TECHNICAL FIELD

The present application relates to technologies related to a cleaner.

BACKGROUND

A cleaner is a device that sucks dirt or dust from the floor. As shown in FIGS. 14 and 15, a conventional cleaner includes a suction assembly 20, having a suction nozzle formed therein to suck air, and a main body 10 connected with the suction assembly via a hose that forms a suction passage. The main body 10 is provided with a suction fan that forms negative pressure for sucking air through the suction nozzle, and either the suction assembly 20 or the main body 10 is provided with a dust collector in which the dust sucked through the suction nozzle is collected.

The suction assembly 20 is moved by force that a user applies thereto, and the main body 10 follows the suction assembly 20. When the suction assembly 20 is moved by the user, the main body 10 is dragged by tension exerted on the hose. Recently, a cleaner equipped with a driving motor at a main body has been released. The main body 10 of such a cleaner may be moved by driving force of the driving motor, which is transmitted to wheels and rotates the same.

In this case, traveling wheels 15 are mounted to two opposite side portions of the main body 10, and a pair of driving motors is mounted to the main body 10 to respectively drive the two traveling wheels 15. Rotating force generated by each of the driving motors is transmitted to the corresponding traveling wheel 15 via a plurality of gears G1, G2, G3, G4 and G5. FIG. 14 schematically illustrates spur gears to explain the engagement relationship of the gears G1, G2, G3, G4 and G5. The gears G1, G2, G3, G4 and G5 are tooth-engaged with each other.

Described in detail, the first gear G1 is coupled to a rotating shaft of the driving motor, and the fifth gear G5 is coupled to the traveling wheel 15. When the first gear G1 is rotated by the driving motor, the second to fourth gears G2, G3 and G4 are rotated sequentially, and the fifth gear G5 is finally rotated. The gears constituted in this way enable the traveling wheel 15 to rotate at a reduction gear ratio of n:1 (i.e. while the driving motor rotates n times, the traveling wheel rotates once, where n>1).

The structure in which the rotating force of the driving motor is transmitted to the traveling wheel via the gears is capable of stably increasing a torque and of reducing the transfer of a shock to the rotating shaft of the driving motor because the gears G1, G2, G3, G4 and G5 absorb the shocks applied to the traveling wheel 15 for various reasons, for example, when a user accidentally drops the main body 10 to the floor. However, if the main body 10 is forcibly moved when the driving motor is in an off state (for example, if the main body 10 is manually dragged by tension exerted on the hose when a user moves the suction assembly 20), frictional force between the gears G1, G2, G3, G4 and G5 becomes a cause of inhibiting smooth movement of the main body 10.

For example, as shown in FIG. 15, when the moving direction of the suction assembly 20 is changed while the driving motor is off, a moment is applied to the main body 10 by the tension exerted on the hose. At this time, if the two traveling wheels 15 are smoothly rotated, change of direction of the main body 10 may be easily realized. However, in the process of changing the direction, reaction force acts on the main body 10 in a direction different from the direction in which the main body 10 is pulled by the hose due to frictional force between the traveling wheels 15 and the floor as well as frictional force between the gears G1, G2, G3, G4 and G5, which may occasionally cause a problem in which the main body 10 turns over in the course of changing the direction.

Further, when the main body 10 is forcibly moved at a predetermined speed or more by the tension exerted on the hose, the moving speed of the main body 10 exceeds the rotating speed of the traveling wheels 15, which is determined by the reduction gear ratio, which may cause the main body 10 to slip on the floor and consequently to wobble from side to side.

SUMMARY

In general, one innovative aspect of the subject matter described in this specification can be implemented in a cleaner comprising: a main body that is configured to generate suction force; a suction assembly that is configured to receive and guide dust to the main body; and a coupling hose that couples the suction assembly to the main body, wherein the main body includes: an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a motor cover that is configured to cover the driving motor such that the driving motor is located in a space between the first surface of the case and the motor cover, a rotating shaft that is coupled to the driving motor and that is configured to transfer driving force generated by the driving motor to the traveling wheel, and a coupling unit that couples the rotating shaft to the traveling wheel.

The foregoing and other implementations can each optionally include one or more of the following features, alone or in combination. In particular, one implementation includes all the following features in combination. The motor cover includes: a first plate that faces the traveling wheel and that includes a shaft hole through which the rotating shaft passes, a partition wall that couples the first plate to the first surface of the case, and a coupling mount that protrudes from the partition wall and that is fixed to the first surface of the case by a fastening member. The motor cover includes: a first plate that faces the traveling wheel and that includes a shaft hole through which the rotating shaft passes, a partition wall that couples the first plate to the first surface of the case, and a plurality of coupling mounts that are arranged symmetrically around the rotating shaft, each of the plurality of coupling mounts (i) protruding from a respective portion of the partition wall and (ii) being fixed to the first surface of the case by a respective fastening member. The case includes: a mount-coupling boss that protrudes from the first surface of the case, and wherein the fastening member is configured to (i) pass through the coupling mount and (ii) fix the coupling mount to the mount-coupling boss.

The main body further includes: a bearing that is coupled to the driving motor, that is configured to support the rotating shaft, and that is fixed to the first plate of the motor cover, and wherein at least a portion of the bearing is located in the space between the first surface of the case and the motor cover. The driving motor includes: a stator, a bearing coupling plate that includes a first surface that is coupled to the bearing and a second surface that is coupled to the stator, and an outer rotor that is located adjacent to the stator relative to the bearing, that is coupled to the rotating shaft, and that includes permanent magnets arranged on an inner surface of the outer rotor. The main body further includes: a bearing support plate that includes (i) a first surface that is coupled to the bearing to support the bearing and (ii) a second surface that is coupled to the first plate of the motor cover. The motor cover further includes: a rib including a circular-shaped wall that protrudes from the first plate toward the traveling wheel. The motor cover further includes: a plurality of cover-reinforcing ribs that protrude from an outer surface of the circular-shaped wall, that are arranged around the circular-shaped wall, and that are coupled to the first plate. The coupling unit includes: a rotating plate that includes a hub that is coupled to the rotating shaft, and a plurality of wheel-coupling bosses that protrude from the rotating plate toward the traveling wheel and that are symmetrically arranged about the hub. The traveling wheel includes: a plurality of fastening holes corresponding to the plurality of wheel-coupling bosses, wherein the plurality of wheel-coupling bosses of the coupling unit are fixed to the traveling wheel by a plurality of fastening members, and wherein each of the plurality of fastening members is configured to (i) pass through the respective fastening hole and (ii) fix the respective wheel-coupling boss to the traveling wheel.

In general, another innovative aspect of the subject matter described in this specification can be implemented in a cleaner comprising: a main body that is configured to generate suction force; a suction assembly that is configured to receive and guide dust to the main body; and a coupling hose that couples the suction assembly to the main body, wherein the main body includes: an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a rotating shaft that is coupled to the driving motor and that is configured to transfer driving force generated by the driving motor to the traveling wheel, a bearing that is coupled to the driving motor and that is configured to support the rotating shaft, a partition wall that protrudes from a first surface of the case, where the partition wall and the first surface of the case define (i) a space to accommodate the driving motor and (ii) an opening to the space, a bearing support plate that covers the opening to the space and that is coupled to the bearing, where at least a portion of the bearing is located in the space, and a coupling unit that is located between the bearing support plate and the traveling wheel and that couples the rotating shaft to the traveling wheel.

The foregoing and other implementations can each optionally include one or more of the following features, alone or in combination. In particular, one implementation includes all the following features in combination. The case further includes: a support-plate-coupling boss that protrudes from an outer surface of the partition wall, wherein the bearing support plate includes a fastening hole corresponding to the support-plate-coupling boss, and wherein the bearing support plate is fixed to the support-plate-coupling boss by a fastening member, the fastening member being configured to pass through the fastening hole and fix the bearing support plate to the support-plate-coupling boss. The case further includes: a plurality of support-plate-coupling bosses that protrude from an outer surface of the partition wall, wherein the bearing support plate includes a plurality of fastening holes corresponding to the plurality of support-plate-coupling bosses, and wherein the bearing support plate is fixed to the plurality of support-plate-coupling bosses by a plurality of fastening members, each of the plurality of fastening members being configured to pass through the respective fastening hole and fix the bearing support plate to the respective support-plate-coupling boss. The main body further includes: a tubular-shaped shock-absorbing member that comprises a flexible material and that is located between the support-plate-coupling boss and the bearing support plate, and wherein the fastening member passes through the tubular-shaped shock-absorbing member. The traveling wheel includes: a wheel body that is coupled to the coupling unit, and a ring-shaped shock-absorbing band that comprises a flexible material and that wounds the wheel body. The wheel body includes: a first circular-shaped rib that includes a first surface and a second surface, a plurality of outward radial ribs that are coupled to the first surface of the first circular-shaped rib at first portions of the first surface, and a plurality of inward radial ribs that are coupled to the second surface of the first circular-shaped rib at second portions of the second surface, wherein each of the first portions and each of the second portions are alternately arranged along the first circular-shaped rib, and wherein the first circular-shaped rib, the plurality of outward radial ribs, and the plurality of inward radial ribs protrude from a surface of the wheel body. The wheel body further includes: a second circular-shaped rib that is concentric with the first circular-shaped rib and that has a smaller radius than the first circular-shaped rib, and wherein the plurality of inward radial ribs couple the first circular-shaped rib to the second circular-shaped rib. The main body further includes: a first traveling wheel (i) that is coupled to a second surface of the case, the second surface being located in an opposite side of the first surface of the case and (ii) that is configured to rotate based on driving force generated by the driving motor, and a caster that is located on a third surface of the case, wherein the caster is located between the first surface of the case and the second surface of the case. The caster is located closer to a coupling portion between the coupling hose and the main body than the rotating shaft of the driving motor. The caster includes: a first rotating shaft that is supported by the case and that is parallel to the rotating shaft of the driving motor.

The subject matter described in this specification can be implemented in particular examples so as to realize one or more of the following advantages. Comparing to a conventional cleaner, a cleaner includes a main body that can self-travel using a driving motor. Thus, the cleaner can stably move without wobbling or turning over even when the main body is forcibly moved (in this specification, wobbling or turning over is referred as "manually dragged") by tension exerted on a hose while the driving motor is off.

In addition, the cleaner includes a rotating shaft of a driving motor that is directly fastened to a traveling wheel. Thus, the traveling wheel can smoothly rotate when a main body is manually dragged.

Furthermore, the cleaner includes an improved traveling wheel structure that reduces shock to a rotating shaft of a driving motor.

Moreover, the cleaner includes a circuit preventing a short-circuit in a driving motor even when a main body is exposed to moisture or water.

The details of one or more examples are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
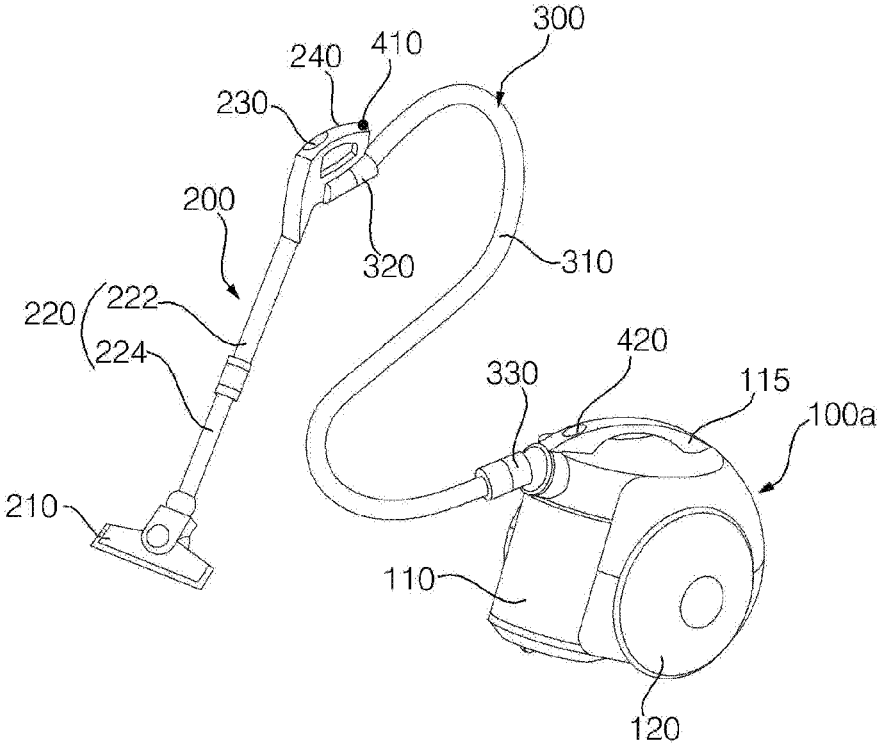
FIG. 1 is a diagram illustrating an example cleaner.
Figure 2:
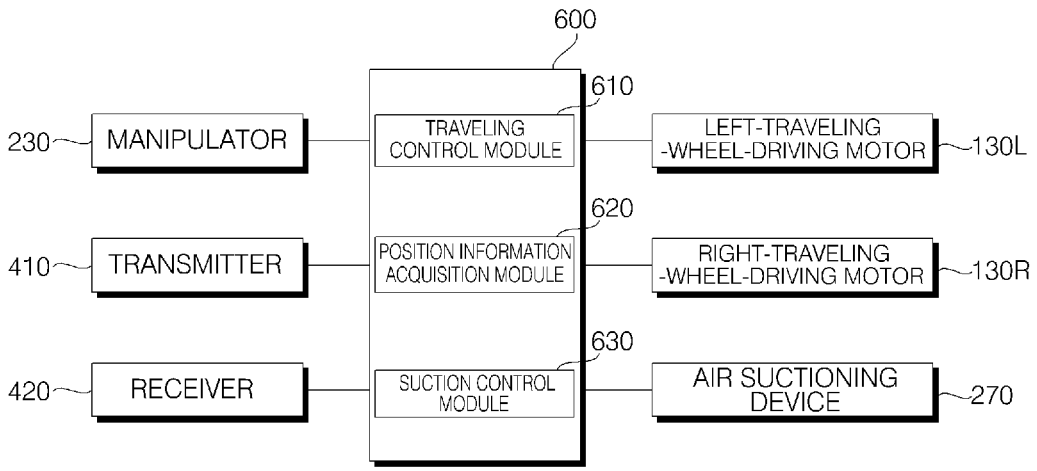
FIG. 2 is a diagram illustrating an example block diagram of a cleaner.

FIG. 1 illustrates an example cleaner. FIG. 2 illustrates an example block diagram of a cleaner.

Referring to FIG. 1, a cleaner may comprise a main body 100*a* and a suction assembly 200. The main body 100*a* and the suction assembly 200 are connected to each other through a coupling hose 300, and air sucked by the suction assembly 200 flows into the main body 100*a* through the coupling hose 300. The main body 100*a* may include a dust collection container for collecting dust contained in the air sucked into the main body 100*a* through the coupling hose 300. Further, the main body 100*a* may include an air suctioning device 270, e.g., a motor, for supplying suction force to the suction assembly 200 through the coupling hose 300 so as to suck external air through the suction assembly 200.

The suction assembly 200 may include a suction head 210 having a suction nozzle formed therein to suck dirt or dust, an air suction wand 220 extending from the suction head 210 and forming a passage through which dirt or dust sucked through the suction nozzle moves, and a handle 240 provided at the upper end of the air suction wand 220. When a user intends to move the suction assembly 200, he/she may hold the handle 240 and may push or pull the same. The suction nozzle of the suction head 210 faces the floor to be cleaned, and dirt or dust on the floor is therefore sucked through the suction nozzle.

The air suction wand 220 forms a passage through which air sucked through the suction head 210 moves. The air suction wand 220 may include a lower wand 224 connected with the suction head 210, and an upper wand 222 slidably connected with the lower wand 224. As a result of the upper wand 222 sliding along the lower wand 224, the overall length of the air suction wand 220 may be increased or decreased. A user may adjust the length of the air suction wand 220 so that the handle 240 is placed above the user's waist.

Air sucked through the suction head 210 flows into the coupling hose 300 through the end of the coupling hose 300 that is connected with the air suction wand 220, and the air flows out of the coupling hose 300 through the opposite end of the coupling hose 300 that is connected with the main body 100*a*. The coupling hose 300 may include a suction assembly connection part 320 connected with the suction assembly 200, a main body connection part 330 connected with the main body 100*a*, and a hose part 310 extending lengthwise between the suction assembly connection part 320 and the main body connection part 330. The hose part 310 may be freely bent depending on the movement of the suction assembly 200. In some implementations, the hose part 310 can be configured as a corrugated hose. The position of the suction assembly 200 relative to the main body 100*a* may vary in response to user manipulation. Because the moving range of the suction assembly 200 is limited by the length of the coupling hose 300, the suction assembly 200 cannot move further than a predetermined distance from the main body 100*a*.

The suction assembly connection part 320 and the main body connection part 330 are formed of a rigid material, and are moved integrally with the suction assembly 200 and the main body 100*a*, respectively. The main body connection part 330 may be detachably coupled to the main body 100*a*, and the suction assembly connection part 320 may be detachably coupled to the suction assembly 200.

The main body 100*a* may include a case 110 for forming the external appearance thereof and a pair of traveling wheels 120 rotatably provided at the two opposite sides of the case 110. Hereinafter, for convenience of explanation, the one of the traveling wheels 120 that is provided at the left side of the main body 100*a* will be referred to as a left traveling wheel 120L, and the other one of the traveling wheels 120 that is provided at the right side of the main body 100*a* will be referred to as a right traveling wheel 120R (refer to FIG. 13).

The main body 100*a* may be further provided with a pair of driving motors 130 for driving the respective traveling wheels 120L and 120R. Hereinafter, for convenience of explanation, the one of the driving motors 130 that drives the left traveling wheel 120L will be referred to as a left-traveling-wheel-driving motor 130L, and the other one of the driving motors 130 that drives the right traveling wheel 120R will be referred to as a right-traveling-wheel-driving motor 130R.

As a result of the traveling wheels 120 being rotated by the driving motors 130, the main body 100*a* is capable of traveling. Since the traveling of the main body 100*a* is achieved by its own driving force, it will be hereinafter referred to as "active follow."

During the active follow, the main body 100*a* can not only travel straight, but can also change the traveling direction. The driving motors 130L and 130R may be controlled by a controller 600 so as to be respectively driven at different rotating speeds from each other, thereby making it possible to change the traveling direction of the main body 100*a*. For example, when the two driving motors 130L and 130R are rotated at the same speed, the main body 100*a* may travel straight. When the right-traveling-wheel-driving motor 130R is rotated at a speed higher than the left-traveling-wheel-driving motor 130L, the main body 100*a* may turn left. The controller 600 may be configured to control other electric/electronic components of the cleaner as well as the driving motors 130. The controller 600 may include a central processing unit (CPU) such as a microprocessor, a non-volatile memory (e.g. a ROM), or a volatile memory (e.g. a RAM). Further, the controller 600 may include a traveling control module 610, a position information acquisition module 620, and/or a suction control module 630, which will be described in detail later.

In addition, the main body 100*a* may be provided with a rechargeable battery. The battery may be charged by putting a plug of the main body 100*a* into a socket for supplying electrical power in homes, etc. Alternatively, the main body 100*a* may be docked with an additional charging device that is electrically connected with a socket, thereby supplying electrical power to the main body 100*a* through a charging terminal and consequently charging the battery.

When the battery is completely charged, the driving motors 130 may be driven by the electrical power supplied from the battery when the main body 100*a* is electrically disconnected from the socket. Further, all electric/electronic components of the cleaner may also be driven by the electrical power supplied from the battery.

The air suctioning device 270 functions to generate negative pressure so that the suction assembly 200 can suck external air. The air suctioning device 270 may include a fan motor and a fan configured to be rotated by the fan motor.

The fan motor may be driven in response to a control signal of the suction control module 630 of the controller 600. The air suctioning device 270 may be disposed in the case 110, and the dust collection container for collecting dirt or dust sucked through the coupling hose 300 may also be mounted to the case 110. In some implementations. the dust collection container is removable from the case 110. In addition, a main body handle 115 may be provided at the top surface of the case 110.

The suction assembly 200 may include a manipulator 230. A user may input various control commands using the manipulator 230, particularly, may input a command for controlling the operation of the air suctioning device 270. In some implementations, the manipulator 230 can be located at a position that enables a user to manipulate the manipulator 230 using his/her thumb while holding the handle 240 in his/her hand.

The manipulator 230 can be located at any suitable portion of the cleaner. For example, the manipulator 230 can be located at the handle 240. The suction control module 630 may control the operation of the fan motor in response to the control command input through the manipulator 230. For example, a user may adjust activation, inactivation, the rotating speed, etc. of the fan motor using the manipulator 230.

The suction assembly 200 may be provided with a transmitter 410 for transmitting ultrasonic waves, and the main body 100*a* may be provided with a receiver 420 for receiving the ultrasonic waves transmitted from the transmitter 410. Depending on the distance from the main body 100*a* to the suction assembly 200, the intensity of the ultrasonic signal that the receiver 420 receives varies, and accordingly the output of the receiver 420 varies. The suction control module 630 may estimate the distance from the main body 100*a* to the suction assembly 200 based on the output value of the receiver 420 and may acquire information about the position of the suction assembly 200. The traveling control module 610 may control the driving motors 130L and 130R based on the acquired position information, thereby controlling the main body 100*a* such that it is located within a predetermined range from the suction assembly 200.

Figure 3:
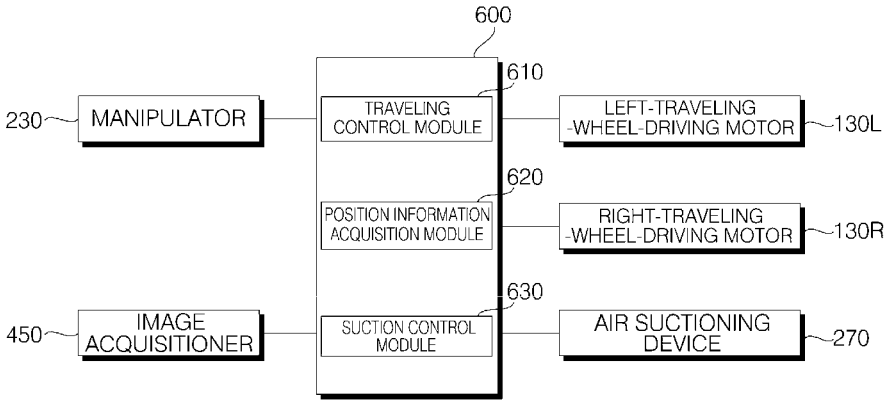
FIG. 3 is a diagram illustrating another example block diagram of a cleaner.

FIG. 3 illustrates another example block diagram of a cleaner. In this implementation, the main body 100*a* can get an image surrounding the cleaner. The main body 100*a* acquires information about the position of the suction assembly 200 relative to the main body 100*a* based on the acquired image.

In particular, the cleaner may include an image acquisitioner 450 for acquiring a surrounding image around the main body 100*a*. The image acquisitioner 450 may be provided at the main body 100*a*, and may include a digital camera having a fixed view. Any device that at least has a function of acquiring a digitized image may be employed as the digital camera. The digital camera may capture a still image or a video. The image used to acquire the position information may be a video frame as well as a still image.

In some implementations, the image acquisitioner 450 can acquire an image of the area before the main body 100*a*. The suction assembly 200 may be provided with a marker. The marker may be configured to have improved identification so as to markedly contrast with the background area, particularly, so as not to be influenced by peripheral illumination. The marker may have a point configuration, a line configuration, a contour configuration, an area configuration, or a combination thereof.

The position information acquisition module 620 extracts the marker from the image acquired by the image acquisitioner 450 and calculates the coordinates of the marker based on the extraction result. Since the image acquisitioner 450 has a fixed view, it is possible to acquire the information about the position of the marker relative to the main body 100*a* (e.g. the distance from the main body 100*a* to the marker or the direction in which the marker is located relative to the main body 100*a*) from the coordinates of the marker calculated based on the acquired image.

In order to enable the marker to appear in the image acquired by the image acquisitioner 450, the marker can be located at the handle 240, which is usually located beside or behind the user during the cleaning process.

In a cleaning process, the handle 240 is located at an almost constant height from the floor. Therefore, based on the assumption that the handle 240 is located at a constant height, when the marker disposed at the handle 240 appears at a relatively low position in the image acquired by the image acquisitioner 450, it may be determined that the suction assembly 200 is spaced a relatively long distance apart from the main body 100*a*. According to this principle, the position information acquisition module 620 may acquire information about the position of the suction assembly 200 from the position of the marker in the image (e.g. the coordinates of the marker in the image) acquired by the image acquisitioner 450. Further, based on the extent to which the marker in the image is biased to the left or right, the direction in which the marker is located relative to the main body 100*a* may also be estimated.

Based on the position information acquired through the above-described process, the traveling control module 610 may control the driving motors 130L and 130R so that the main body 100*a* is located within a predetermined range from the suction assembly 200.

Figure 4:
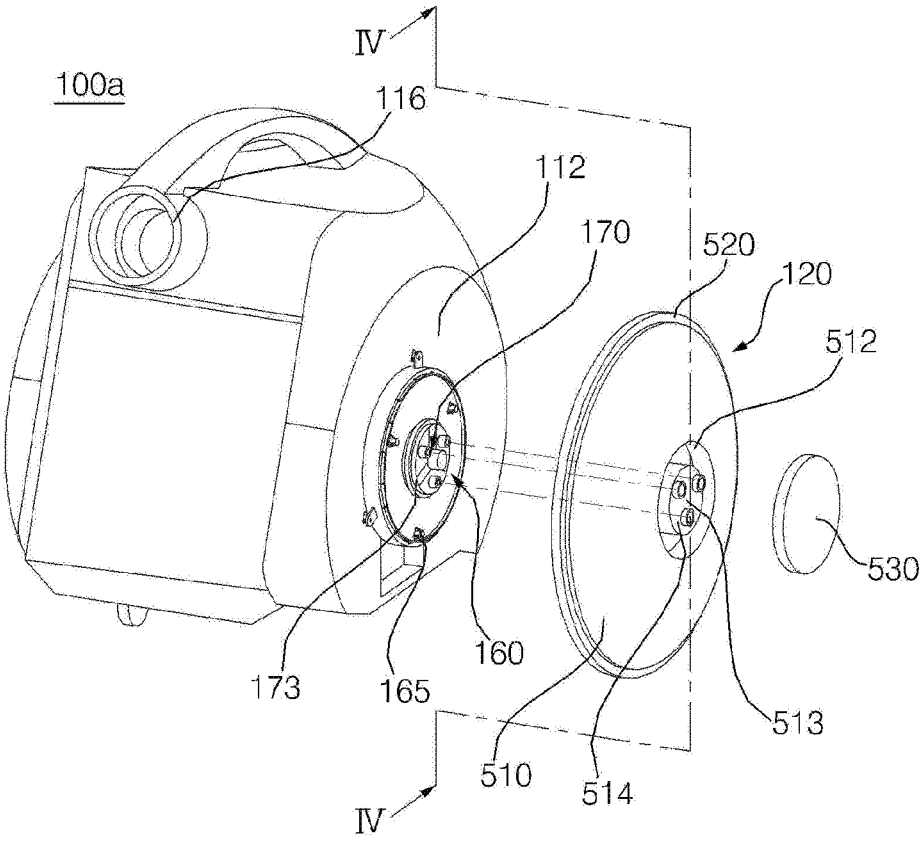
FIG. 4 is a diagram illustrating an example main body of the cleaner in FIG. 1.
Figure 5:
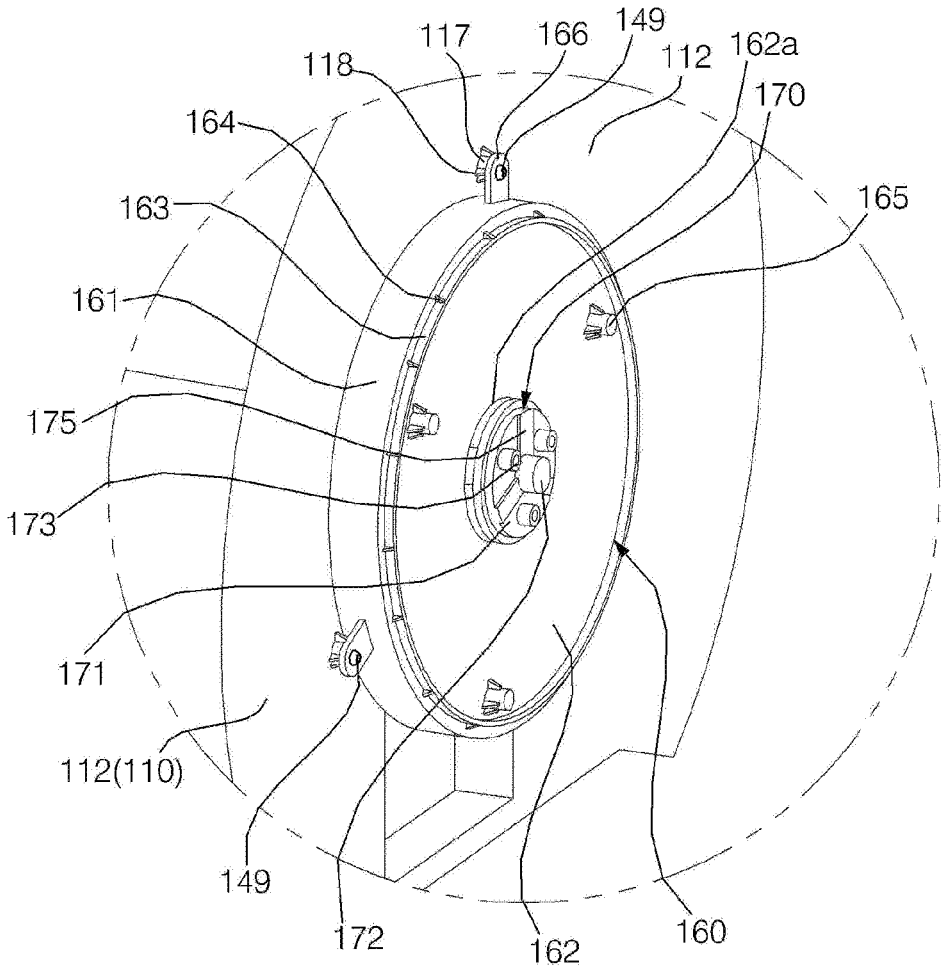
FIGS. 5 and 6 are diagrams illustrating the example main body in FIG. 4.
Figure 6:
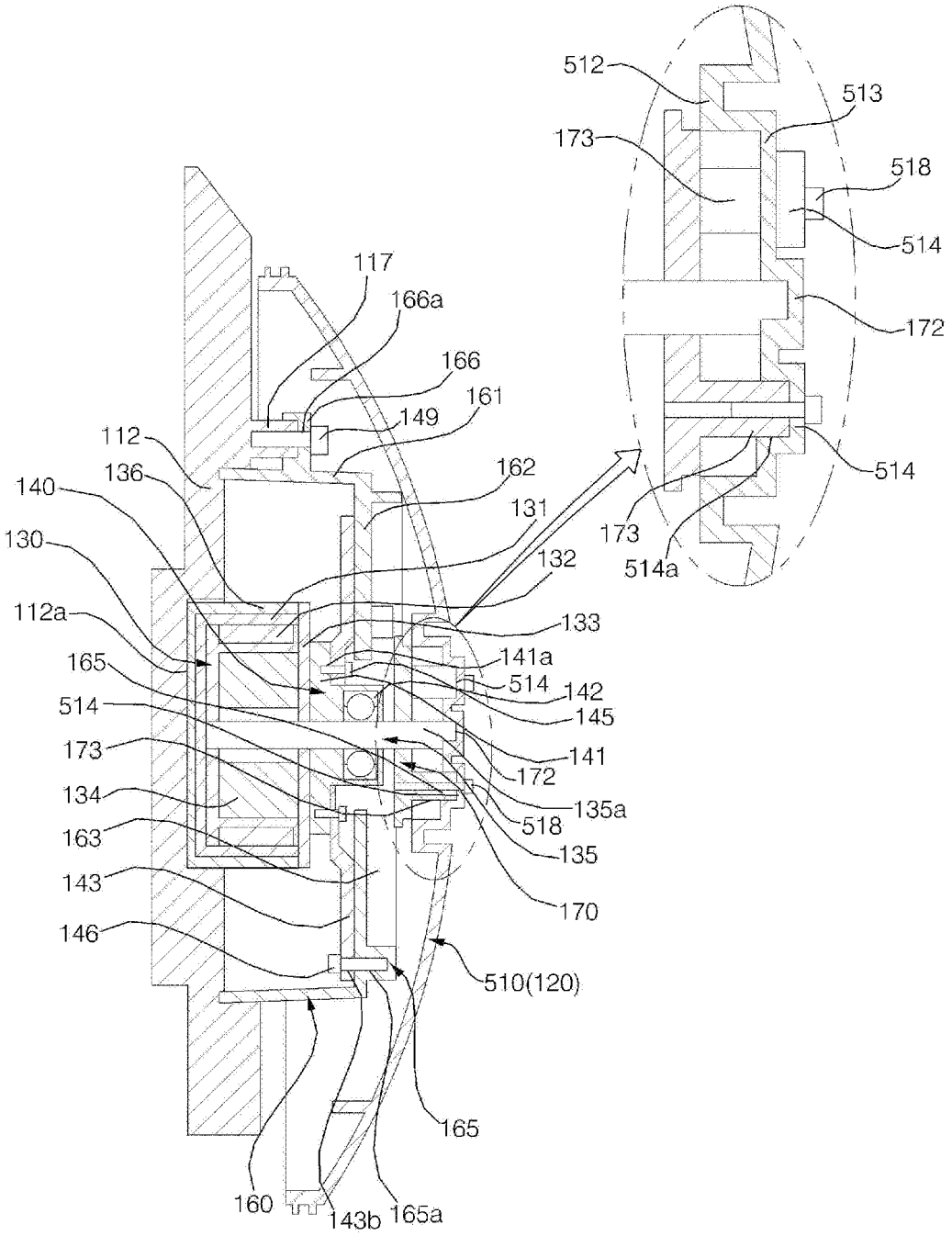

FIG. 4 illustrates an example main body of the cleaner in FIG. 1. FIGS. 5 and 6 illustrate the example main body in FIG. 4. In particular, FIG. 6 is a sectional view taken along line IV-IV in FIG. 4.

Referring to FIGS. 1, 4, 5 and 6, the case 110 may accommodate the air suctioning device 270, the driving motors 130, the dust collection container, the filter and the battery, and may have a connection hole 116 formed in the front surface thereof, which is connected with the main body connection part 330 of the coupling hose 300. The top surface of the case 110 is configured to be opened and closed. A user may open the top surface of the case 110, and may take the dust collection container out of the case 110 to remove dirt or dust therefrom.

Motor covers 160 may be coupled to two opposite side surfaces 112 of the case 110 that face the traveling wheels 120L and 120R, respectively.

In this specification, the descriptions with reference to the left traveling wheel 120L can be similarly applied to the right traveling wheel 120R.

The driving motor 130 is accommodated in the motor cover 160. A predetermined space may be formed between the motor cover 160 and the side surface 112 of the case 110, and the driving motor 130 may be accommodated in the space. The side surface 112 of the case 110 may have a recess 112*a* formed therein corresponding to the position of the driving motor 130, and at least a portion of the driving motor 130 may be disposed in the recess 112*a*. If the driving motor 130 is in contact with the side surface 112 of the case 110, vibration of the driving motor 130 may be directly transferred to the case 110, and a rattling noise may also be generated. In order to avoid this problem, the driving motor 130 is spaced apart from the side surface 112 of the case 110.

Since the driving motor 130 is located in the motor cover 160, even when the main body 100*a* is wetted with water (e.g. when the traveling wheel 120 travels on a wet floor and thus water drops from the edge of the wheel to the motor cover 160, or when water is spilt on the main body 100*a*), the driving motor 130 is prevented from being wetted, thereby preventing a short-circuit in the driving motor 130.

The motor cover 160 can include any suitable material(s). In some implementations, the motor cover 160 can include a synthetic resin material. In some other implementations, the motor cover 160 can include a metal material.

The traveling wheel 120 may be connected to the rotating shaft 135 of the driving motor 130 by a coupling unit 170. The coupling unit 170, which functions to connect the traveling wheel 120 to the rotating shaft 135, is provided with a hub 172, which is coupled to the rotating shaft 135. After the coupling unit 170 is disposed at the outside of the motor cover 160 and the hub 172 is coupled to the rotating shaft 135, the traveling wheel 120 is coupled to the coupling unit 170.

The motor cover 160 may include a side plate 162, which faces the traveling wheel 120 and has therein a shaft hole 162*a* through which the rotating shaft 135 of the driving motor 130 passes, and a partition wall 161, which protrudes in a tubular shape from the periphery of the side plate 162 and has an open end that is located on the side surface 112 of the case 110.

The side plate 162 is formed in a substantially circular shape, and the shaft hole 162*a* is formed in the center of the side plate 162. The diameter of the shaft hole 162*a* may be set to be much larger than the diameter of the rotating shaft 135, and a portion of a bearing 140 for supporting the rotating shaft 135 may pass through the shaft hole 162*a*. Heat generated from the driving motor 130 may be dissipated to the outside of the motor cover 160 through the shaft hole 162*a*.

The motor cover 160 may have a rib 163, which protrudes from the side plate 162 toward the traveling wheel 120 and is formed in a circular shape (or a ring shape) about the rotating shaft 135. The rib 163 may be formed in the vicinity of the edge of the side plate 162.

The motor cover 160 may further have a plurality of cover-reinforcing ribs 164, which protrude from the outer surface of the circular-shaped rib 163 and are arranged in the circumferential direction of the rib 163, and each of which has an end connected with the side plate 162.

These ribs 163 and 164 function to enhance the strength of the motor cover 160 and further to disperse external shocks applied to the motor cover 160, thereby preventing the motor cover 160 from being deformed by external shocks. Therefore, it is possible to securely support the bearing 140, which is supported by the side plate 162 of the motor cover 160, and the driving motor 130, which is coupled to the bearing 140. Further, with the decrease in wobbling of the rotating shaft 135 of the driving motor 130, the traveling wheel 120 does not easily wobble, either.

Furthermore, since the circular-shaped rib 163 protrudes from the side plate 162, even if the main body 100*a* is wetted with water, the rib 163 prevents water from flowing to the center portion of the side plate 162, and consequently prevents water from entering the motor cover 160 through the shaft hole 162*a*.

The partition wall 161 may be provided with a coupling mount 166, which protrudes from the outer surface of the partition wall 161. In the state in which the open end of the partition wall 161, which is opposite the end connected with the side plate 162, is in close contact with the side surface 112 of the case 110, the coupling mount 166 is coupled to the side surface 112 of the case 110 by a fastening member 149 such as a screw or a bolt. As a result, the close contact between the open end of the partition wall 161 and the side surface 112 of the case 110 may be maintained, i.e., the partition wall 161 is fixed to the side surface 112.

The case 110 may be provided with a mount-coupling boss 117 at the side surface 112 thereof, which corresponds to the coupling mount 166 provided at the partition wall 161. The mount-coupling boss 117 may protrude from the side surface 112 of the case 110 toward the traveling wheel 120.

The coupling mount 166 may have a fastening hole 166*a* formed therein. After passing through the fastening hole 166*a*, the fastening member 149 may be fastened to the mount-coupling boss 117. The coupling mount 166 may have a recess formed therein, into which an end portion of the mount-coupling boss 117 is inserted. In this case, the fastening hole 166*a* communicates with the recess.

A plurality of ribs 118 may protrude from the outer circumferential surface of the mount-coupling boss 117. One end of each of the ribs 118 may be connected with the side surface 112 of the case 110.

The coupling mount 166 may be provided in a plural number so as to be symmetrically arranged about the rotating shaft 135, and the mount-coupling boss 117 may also be provided in a plural number so as to be arranged corresponding to the respective coupling mounts 166. In some implementations, three coupling mounts 166 are arranged so as to be spaced 120 degrees apart from one another about the rotating shaft 135.

The driving motor 130 can be any suitable motor to rotate the wheels 120R, 120L. In this example, the driving motor 130 is implemented using an outer-rotor-type motor including a stator 134 around which an induction coil is wound. The driving motor 130 can be located at the center and permanent magnets 132 are arranged along the inner circumferential surface of an outer rotor 131 that surrounds the stator 134. In some other implementations, various motors can be used to implement the driving motor 130.

The driving motor 130 may include a bearing coupling plate 133, which is coupled to the bearing 140, and a motor housing 136, which is coupled to the bearing coupling plate 133 and forms a space for accommodating the outer rotor 131.

The bearing coupling plate 133 may have one surface, to which the bearing 140 is coupled, and the opposite surface, to which the stator 134 is coupled. Although not illustrated in the drawings, the bearing coupling plate 133 and the bearing 140 may be coupled to each other by means of an additional fastening member or by means of welding or bonding.

The rotating shaft 135 is coupled to the center of the outer rotor 131. When the outer rotor 131 is rotated by magnetic force exerted between the stator 134 and the permanent magnets 132, the rotating shaft 135 is also rotated integrally with the outer rotor 131.

The driving motor 130 may be configured so as to be controlled in speed. A brushless direct current motor (BLDC motor) is suitable for the driving motor 130. The speed of the BLDC motor may be controlled by a vector control method, in which input current of the motor is controlled based on motor speed feedback using a proportional-integral controller (PI controller), a proportional-integral-derivative controller (PID controller), or the like. Since various other motor speed control methods are already well known in the art, a detailed explanation thereof is omitted.

The bearing 140 functions to support the rotating shaft 135 of the driving motor 130. The rotating shaft 135 may pass through the bearing 140, and the bearing 140 may include a ball bearing 142 to support the rotating shaft 135. The bearing 140 may be secured to the side plate 162 of the motor cover 160, and at least a portion of the bearing 140 may be disposed in the motor cover 160.

The bearing 140 may include a base 141, which has one surface coupled to the bearing coupling plate 133 of the driving motor 130 and the opposite surface coupled to the bearing support plate 143, and a ball bearing 142, which is integrally formed with the base 141.

The bearing support plate 143 may have one surface coupled to the base 141 of the bearing 140 and the opposite surface coupled to the side plate 162 of the motor cover 160. The base 141 may have a plurality of fastening holes 141*a* formed therein so as to be arranged in a circumferential direction about the rotating shaft 135. The bearing support plate 143 may have a plurality of first fastening holes 143*a* formed therein at positions corresponding to the respective fastening holes 141*a*. As a result, fastening members 145 may pass through the corresponding first fastening holes 143*a* and may then be fastened into the corresponding fastening holes 141*a* formed in the base 141.

The bearing support plate 143 is primarily formed of a suitable material having sufficient rigidity. In some implementations, the bearing support plate 143 can include a metal material. In some other implementations, the bearing support plate 143 may include a synthetic resin material.

The bearing support plate 143 may have a plurality of second fastening holes 143*b* formed therein at positions further radially outward than the first fastening holes 143*a*. The second fastening holes 143*b* may be arranged in a circumferential direction about the rotating shaft 135. The side plate 162 may have fastening recesses 165*a* formed therein at positions corresponding to the respective second fastening holes 143*b*. As a result, fastening members 146 may pass through the corresponding second fastening holes 143*b* and may then be inserted and fastened into the corresponding fastening recesses 165*a*.

The side plate 162 may have protrusions 165 protruding from the surface thereof that is opposite the bearing support plate 143, and the fastening recesses 165*a* may be formed in the protrusions 165. The inlets of the fastening recesses 165*a*, into which the fastening members 146 are inserted, may be in close contact with the bearing support plate 143. The protrusions 165 may be located at positions further radially inward than the circular-shaped rib 163, more particularly, may be in close contact with the inner circumferential surface of the rib 163.

The coupling unit 170 may include a circular-shaped rotating plate 171, which has a hub 172 formed at the center thereof so as to be coupled to the rotating shaft 135, and a plurality of wheel-coupling bosses 173, which protrude from the rotating plate 171 toward the traveling wheel 120 and are symmetrically arranged about the hub 172. In order to increase the strength of the coupling unit 170, a plurality of protruding portions 175 may be formed at the rotating plate 171 so as to radially extend from the hub 172.

In some implementations, the coupling unit 170 can include a synthetic resin material. In some other implementations, the coupling unit 170 can include a metal material.

The hub 172 can have a tubular shape such that a distal end portion 135*a* of the rotating shaft 135 can be inserted the hub 172. In some implementations, the rotating shaft 135 may have a flat surface formed at the distal end portion 135*a* thereof. The portion at which the flat surface is formed may have a non-circular cross-sectional shape, and the inner surface of the hub 172 may have a shape corresponding thereto.

In some implementations, three wheel-coupling bosses 173 are arranged so as to be spaced at a certain degree, e.g., 120 degrees, apart from one another relative to the center of the coupling unit 170 (or relative to the rotating shaft 135). The wheel-coupling bosses 173 may have a tubular configuration that protrudes from the rotating plate 171.

The traveling wheel 120 may include a wheel body 510, a shock-absorbing band 520, and a wheel cap 530. The wheel body 510 may have a plurality of fastening holes 514*a* formed therein at positions corresponding to the respective wheel-coupling bosses 173. Fastening members 518 may pass through the corresponding fastening holes 514*a* from the outside of the wheel body 510 and may then be fastened to the corresponding wheel-coupling bosses 173.

The coupling unit 170 is coupled to the rotating shaft 135 of the driving motor 130, and the traveling wheel 120 is coupled to the coupling unit 170 such that the rotating shaft 135 and the traveling wheel 120 rotate about a single axis. In this case, since the reduction gear ratio between the driving motor 130 and the traveling wheel 120 is 1:1, when the main body 100*a* is manually dragged while the driving motor 130 is off, the rotating shaft 135 of the driving motor 130 rotates at the same rpm as the traveling wheel 120. At this time, frictional force between the ball bearing 142 and the rotating shaft 135 acts as primary resistance to rotation of the rotating shaft 135, but frictional resistance does not exist. Therefore, even when the main body 100*a* is passively dragged, the traveling wheels 120 may be smoothly rotated. In particular, since the two traveling wheels 120 have the same operating mechanism, both traveling wheels 120 may be smoothly rotated.

The wheel body 510, which composes the traveling wheel 120, may have a wheel cap insertion recess 512 formed in the outer side surface thereof, into which the wheel cap 530 is fitted. A coupling unit mount 513 may protrude from the bottom of the wheel cap insertion recess 512. When observed from the inside of the wheel body 510, the coupling unit mount 513 forms a recess that is depressed from the inner side surface of the wheel body 510, the bottom of the recess has a substantially flat shape, and bosses 514 having the fastening holes 514*a* therein may protrude from the bottom. The fastening members 518, which are fastened to the wheel-coupling bosses 173 through the fastening holes 514*a*, may be covered with the wheel cap 530.

Figure 7:
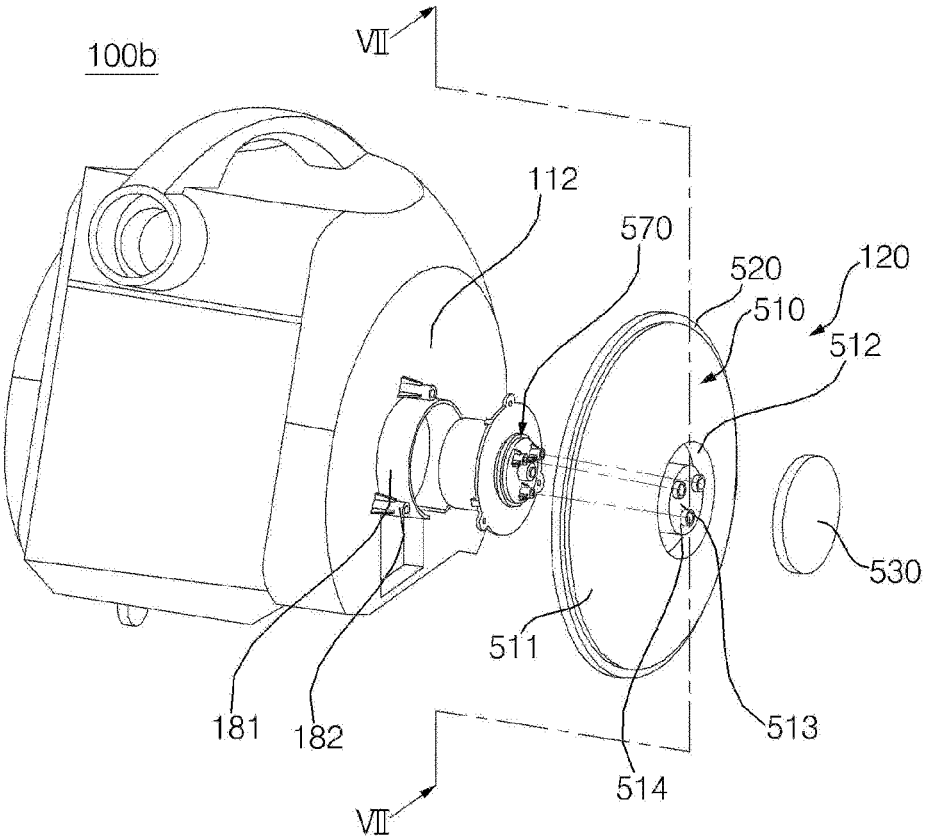
FIG. 7 is a diagram illustrating another example main body of the cleaner in FIG. 1.
Figure 8A:
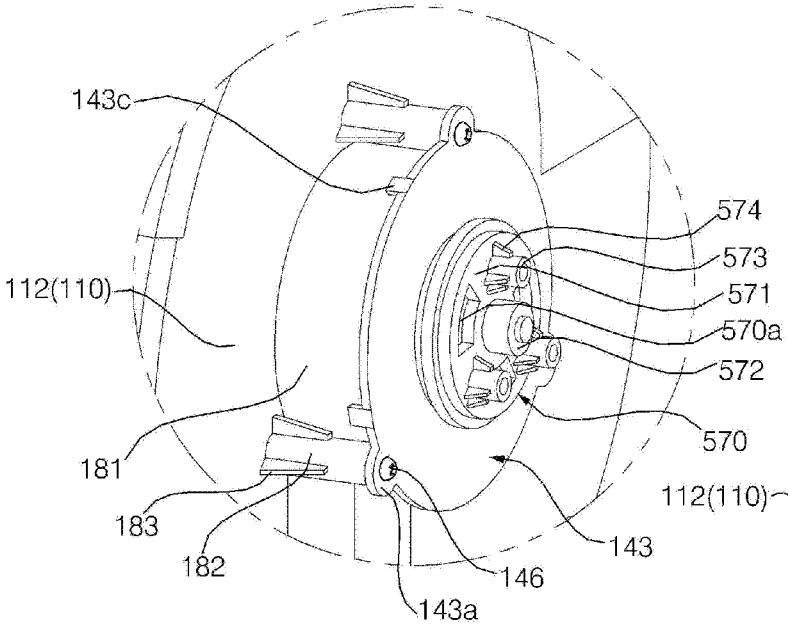
FIGS. 8A and 8B are diagrams illustrating the example main body in FIG. 7.
Figure 8B:
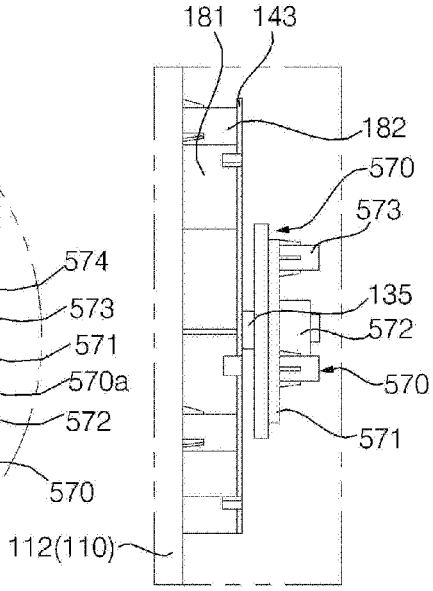
Figure 9A:
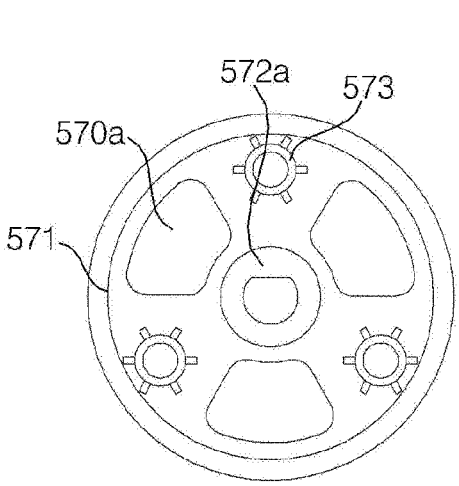
FIGS. 9A and 9B are diagrams illustrating an example coupling unit in FIGS. 8A and 8B.
Figure 9B:
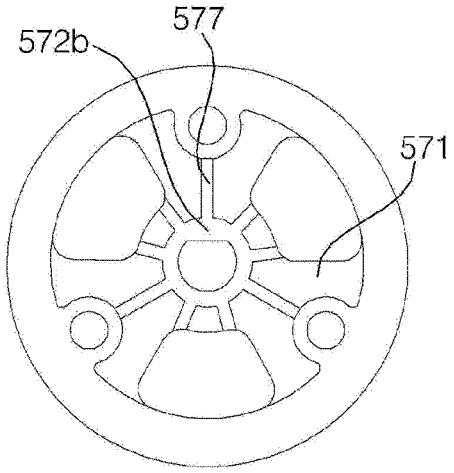
Figure 10:
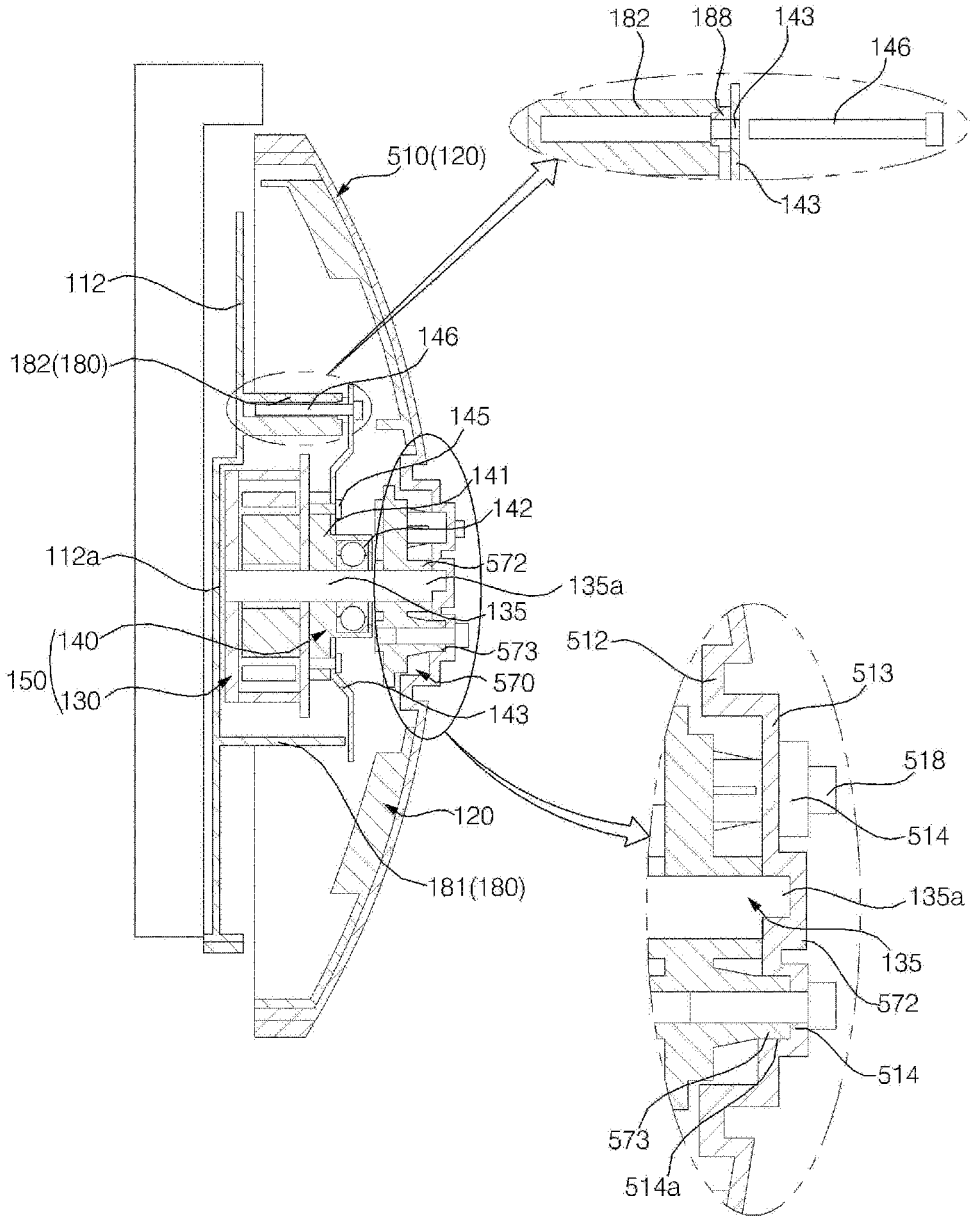
FIG. 10 is a diagram illustrating the example main body in FIG. 7.

FIG. 7 illustrates another example main body of the cleaner in FIG. 1. FIGS. 8A and 8B illustrate the example the example main body in FIG. 7. FIGS. 9A and 9B illustrate an example coupling unit in FIGS. 8A and 8B. FIG. 10 illustrates the example main body in FIG. 7. In particular, FIG. 10 is a sectional view taken along line VII-VII in FIG. 7.

The main body 100*b* may include a case 110 to accommodate an air suctioning device 270 for generating suction force, a traveling wheel 120 provided at each of the two opposite sides of the case 110, a driving motor 130 for rotating the traveling wheel 120, and a bearing 140 coupled to the driving motor 130 so as to support a rotating shaft 135 of the driving motor.

The case 110 may be provided with a partition wall 181, which protrudes in a tubular shape from the one side surface 112 that faces the traveling wheel 120, and the driving motor 130 may be accommodated within the partition wall 181 through an open end of the partition wall 181. In the example of the main body 100*a*, the driving motor 130 is accommodated in the motor cover 160 that is formed separately from the case 110. In this example main body 100*b*, the partition wall 181 defining the region for accommodating the driving motor 130 protrudes from the side surface 112 of the case 110.

A support-plate-coupling boss 182 may protrude from the side surface 112 of the case 110. The support-plate-coupling boss 182 may be formed at positions further radially outward than the partition wall 181, and may be provided in a plural number so as to be symmetrically arranged about the rotating shaft 135 of the driving motor 130. In some implementations, three support-plate-coupling bosses 182 are arranged so as to be spaced 120 degrees apart from one another about the rotating shaft 135. A plurality of ribs 183 may protrude from the outer circumferential surface of each of the support-plate-coupling bosses 182. One end of each of the ribs 183 may be connected with the side surface 112 of the case 110.

The bearing support plate 143 may have a plurality of first fastening holes 143*a* formed therein at positions corresponding to the respective fastening holes 141*a* formed in the base 141 of the bearing 140. Fastening members 145 may pass through the corresponding first fastening holes 143*a*, and may then be fastened into the corresponding fastening holes 141*a* formed in the base 141.

The bearing support plate 143 may have a plurality of coupling tabs 143*c*, which protrude from the periphery of the bearing support plate 143 and have predetermined elasticity. The coupling tabs 143*c* may be in close contact with the outer surface of the partition wall 181.

The bearing support plate 143 may have a plurality of second fastening holes 143*b* formed therein at positions further radially outward than the first fastening holes 143*a*. The second fastening holes 143*b* may be arranged in a circumferential direction about the rotating shaft 135. The second fastening holes 143*b* may be formed at positions corresponding to respective support-plate-coupling bosses 182. As a result, fastening members 146 may pass through the corresponding second fastening holes 143*b* and may then be fastened to the corresponding support-plate-coupling bosses 182.

The open end of the partition wall 181 is covered with the bearing support plate 143 and the bearing 140 is coupled to one surface of the bearing support plate 143. At least a portion of the bearing 140 may be coupled to the bearing support plate 143 within the region defined by the partition wall 181. Fastening members 145 may be coupled to the base 141 of the bearing 140 through the corresponding first fastening holes 143*a*.

A coupling unit 570 may be disposed between the bearing support plate 143 and the traveling wheel 120 so as to be coupled to the traveling wheel 120. The coupling unit 570 may be provided with a hub 572, which is coupled to the rotating shaft 135 of the driving motor 130.

The coupling unit 570 may include a circular-shaped rotating plate 571, which has a hub 572 formed at the center thereof so as to be coupled to the rotating shaft 135, and a plurality of wheel-coupling bosses 573, which protrude from the rotating plate 571 toward the traveling wheel 120 and are symmetrically arranged about the hub 572. A plurality of ribs 574 may protrude from the outer circumferential surface of each of the wheel-coupling bosses 573. One end of each of the ribs 574 may be connected with the rotating plate 571.

The coupling unit 570 can be formed of any suitable material(s). In some implementations, the coupling unit 570 can include a synthetic resin material. In some other implementations, the coupling unit 570 can include a metal material.

The hub 572 may be formed to have a tubular shape so that a distal end portion 135*a* of the rotating shaft 135 is inserted thereinto. The rotating shaft 135 may have a flat surface formed at the distal end portion 135*a* thereof. The portion at which the flat surface is formed may have a non-circular cross-sectional shape, and the inner surface of the hub 572 may therefore have a shape corresponding thereto.

The hub 572 has a tubular configuration, and the rotating plate 571 is extended from the outer surface of the hub 572. Therefore, one end portion 572*a* of the hub 572 protrudes from the front surface of the rotating plate 571 (the surface that is oriented toward the wheel body 510), and the opposite end portion 572*b* of the hub 572 protrudes from the rear surface of the rotating plate 571 (the surface that is oriented toward the support plate 143 of the bearing).

As shown in FIG. 9B, a plurality of ribs 577 may be formed in the rear surface of the rotating plate 571 so as to protrude from the opposite end portion 572*b* of the hub 572 and extend radially. The ribs 577 function to disperse the load applied to the hub 572, thereby maintaining the strength of the coupling unit 570.

The rotating plate 571 may have a plurality of through-holes 570*a* formed therein about the hub 572. These through-holes 570*a* may be arranged so as to be spaced apart from one another at uniform angles in the circumferential direction about the hub 572. In some implementations, the through-holes 570*a* are spaced 120 degrees apart from one another about the hub 572, and each of the through-holes 570*a* is disposed between the two adjacent wheel-coupling bosses 573. The coupling unit 570 having the through-holes 570*a* therein functions to disperse shocks applied to the traveling wheel 120 and to absorb the shocks. Specifically, when the coupling unit 570 is primarily formed of a synthetic resin material, it has improved shock absorption.

In some implementations, three wheel-coupling bosses 573 are arranged so as to be spaced at a certain degree, e.g., 120 degrees, apart from one another relative to the center of the coupling unit 570 (or relative to the rotating shaft 135). The wheel-coupling bosses 573 may have a tubular configuration that protrudes from the rotating plate 571.

The wheel body 510 may have fastening holes 514*a* formed therein at positions corresponding to the respective wheel-coupling bosses 573, and these fastening holes 514*a* may be defined by bosses 514 protruding from the wheel body 510*a*.

A tubular-shaped shock-absorbing member 188 may be interposed between the support-plate-coupling boss 182 and the bearing support plate 143. One end portion of the shock-absorbing member 188 may be inserted into the support-plate-coupling boss 182. The shock-absorbing member 188 may include a flexible material having elasticity, for example, rubber. A fastening member 146 may pass through the shock-absorbing member 188 and may then be fastened to the wheel-coupling boss 573.

Figure 11A:
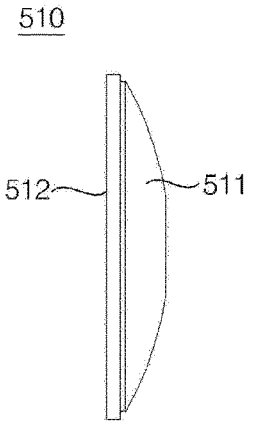
FIG. 11A is a diagram illustrating an example wheel body.
Figure 11B:
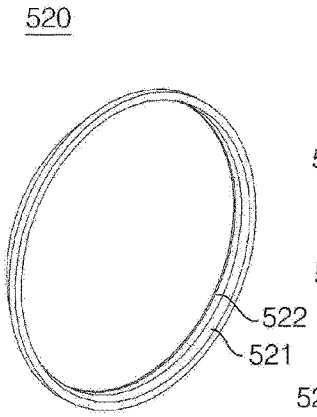
FIG. 11B is a diagram illustrating an example shock-absorbing band.
Figure 11C:
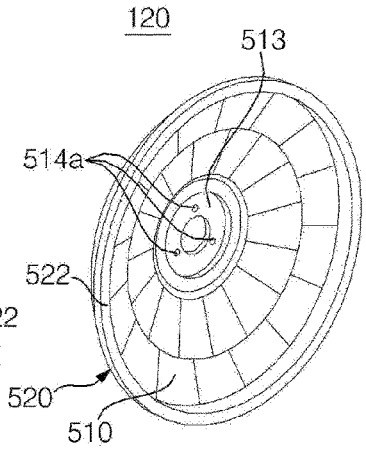
FIG. 11C is a diagram illustrating an example assembly including the example wheel body in FIG. 11A and the example shock-absorbing band in FIG. 11B.
Figure 12:
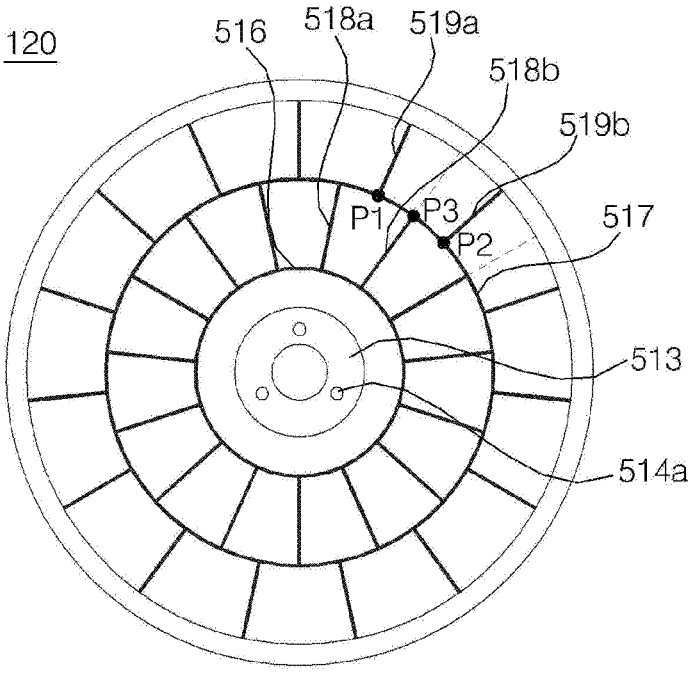
FIG. 12 is a diagram illustrating an example wheel body.

FIG. 11A illustrates an example wheel body. FIG. 11B illustrates an example shock-absorbing band. FIG. 11C illustrates an example assembly including the example wheel body in FIG. 11A and the example shock-absorbing band in FIG. 11B. FIG. 12 illustrates an example wheel body.

Referring to FIGS. 11A to 11C and 12, the traveling wheel 120 may include a wheel body 510, a ring-shaped shock-absorbing band 520 wound around the outer circumferential surface of the wheel body 510, and a wheel cap 530 coupled to a recess formed in the center of the wheel body 510.

The wheel body 510 may include a frame portion 511 having a circular plate configuration and an edge portion 512 formed along the circumference of the frame portion 511. The frame portion 511 may have a plurality of fastening holes 514*a* formed in the center portion thereof at positions corresponding to the respective wheel-coupling bosses 573 provided at the coupling unit 570.

The edge portion 512 may extend along the circumference of the frame portion 511, and may include an inner surface that faces the inner side surface 112 of the case 110 and an outer surface that is in contact with the shock-absorbing band 520.

A first circular rib 517, outward radial ribs 519*a* and 519*b*, and inward radial ribs 518*a* and 518*b* may be formed in the inner side surface of the frame portion 511. The first circular rib 517 may have a ring shape (or a circular shape) formed about the rotating shaft 135 of the driving motor 130. In some implementations, the wheel body 510 may be an injection-molded component that is primarily formed of a synthetic resin material. The inner side surface of the frame portion 511 may be formed to be a concave surface.

The outward radial ribs 519*a* and 519*b* may be provided in a plural number so as to extend outwards from the first circular rib 517 in the radial direction, and each of the outward radial ribs 519*a* and 519*b* may be connected with the edge portion 512 formed along the circumference of the wheel body 510. The outward radial ribs 519*a* and 519*b* may be connected with the inner surface of the edge portion 512.

The portion at which each of the outward radial ribs 519*a* and 519*b* intersects the first circular rib 517 may form a structure in which three sides intersect (i.e. a "T"-shaped structure). That is, the inward radial ribs 518*a* and 518*b* do not extend from the points P1 and P2 at which the first circular rib 517 intersects the outward radial ribs 519*a* and 519*b*.

Each of the inward radial ribs 518*a* and 518*b* may extend inwards from the first circular rib 517 in the radial direction at a predetermined point that is located between the points P1 and P2 at which the first circular rib 517 intersects the two adjacent ones of the outward radial ribs 519*a* and 519*b*. The portion at which each of the inward radial ribs 518*a* and 518*b* intersects the first circular rib 517 may form a structure in which three sides intersect (i.e. a "T"-shaped structure). That is, the outward radial ribs 519*a* and 519*b* do not extend from the points P3 at which the first circular rib 517 intersects the inward radial ribs 518*a* and 518*b*.

When a shock is applied to the traveling wheel 120, a portion of the shock is transferred to the center portion of the wheel body 510 from the edge portion 512 of the wheel body 510. If the outward radial ribs 519*a* and 519*b* are formed at the regions indicated by dotted lines in FIG. 12, the outward radial ribs 519*a* and 519*b* are located in alignment with the inward radial ribs 518*a* and 518*b*, which prevents the shock applied to the outward radial ribs 519*a* and 519*b* from being effectively dispersed by the first circular rib 517 and causes the shock to be transferred to the inward radial ribs 518*a* and 518*b* to a considerable extent. In this case, the shock may also be applied to the rotating shaft 135 of the driving motor 130 to a considerable extent, causing wobble of the driving motor 130 and resultant wobble of the traveling wheel 120 and even causing damage to the coupling unit 570.

To prevent the wobbling, in some implementations, the outward radial ribs 519*a* and 519*b* and the inward radial ribs 518*a* and 518*b* are alternately arranged so that a shock applied to the outward radial ribs 519*a* and 519*b* is primarily dispersed and absorbed by the first circular rib 517 and is then transferred to the inward radial ribs 518*a* and 518*b*.

The frame portion 511 may have a second circular rib 516 formed at a position further radially inward than the first circular rib 517. The second circular rib 516 is concentric with the first circular rib 517 and has a smaller radius than the first circular rib 517. The inward radial ribs 518*a* and 518*b* may be arranged so as to connect the first circular rib 517 and the second circular rib 516. A shock applied to the inward radial ribs 518*a* and 518*b* may be dispersed by the second circular rib 516.

The shock-absorbing band 520 may include a flexible material having elasticity, e.g., rubber. The shock-absorbing band 520 may include a floor contact portion 521, which generates frictional force between the floor to be cleaned and the shock-absorbing band 520, and a coupling portion 522, which extends inwards from the inner circumferential surface of the floor contact portion 521 in the radial direction and is locked to the periphery of the frame portion 511 so as to prevent the shock-absorbing band 520 from being separated from the wheel body 510.

Figure 13:
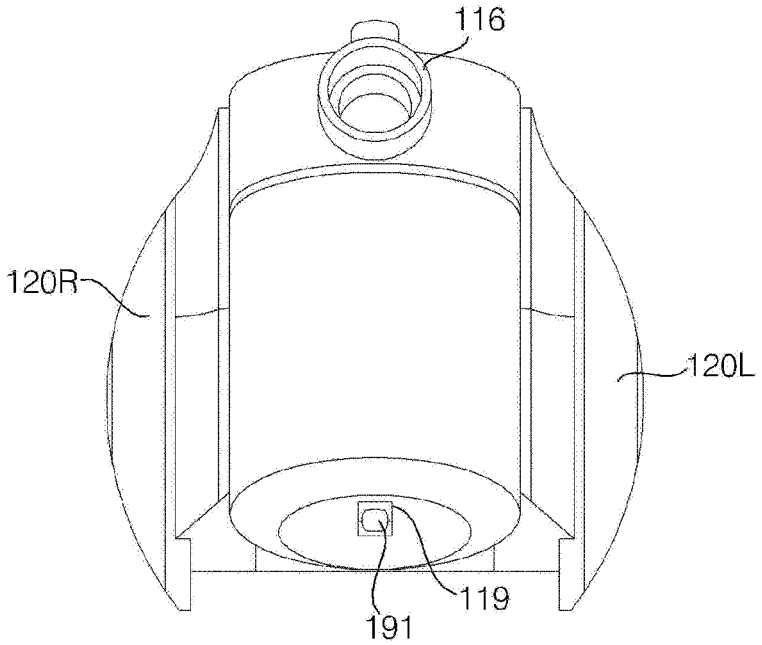
FIG. 13 is a diagram illustrating an example main body including an example caster.
Figure 14:
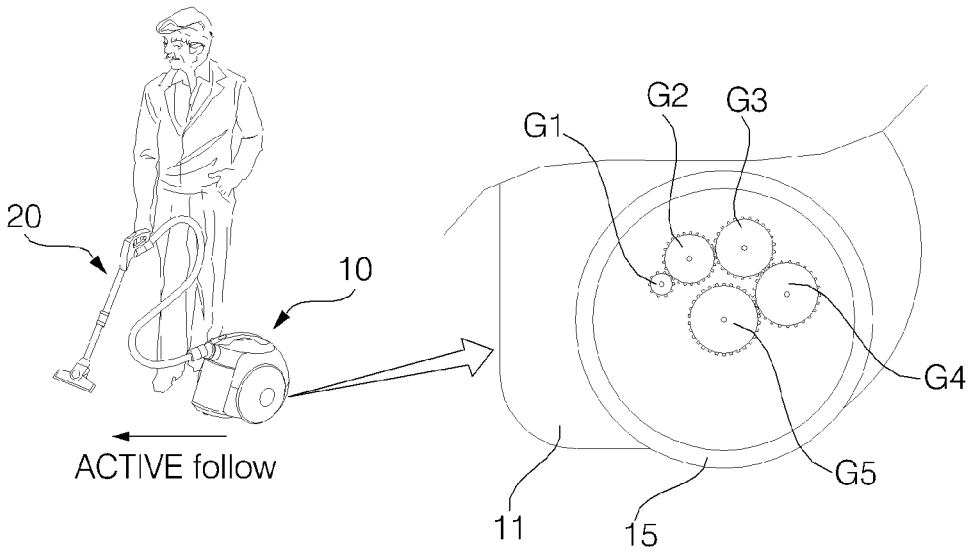
FIG. 14 is a diagram illustrating a conventional cleaner.
Figure 15:
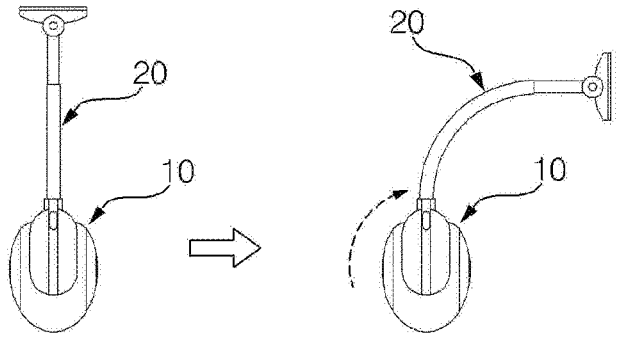
FIG. 15 is a diagram illustrating a conventional cleaner that is manually dragged.

FIG. 13 illustrates an example main body including an example caster. In FIG. 13, a caster 191 is located on the bottom surface of the main body 100*a* or 100*b*.

Referring to FIG. 13, the main body 100*a* or 100*b* may be provided with a caster 191 at the bottom surface of the case 110. When the main body 100*a* or 100*b* is viewed from the front, the caster 191 may be disposed between the two traveling wheels 120L and 120R, which are provided at the two opposite sides of the case 110. The case 110 may have a mounting recess 119 formed therein, in which the caster 191 is mounted. The caster 191 is rotatably mounted in the mounting recess 119 such that a portion thereof is exposed to the outside of the mounting recess 119 and is brought into contact with the floor to be cleaned. The caster 191 functions to prevent the main body 100*a* or 100*b* from becoming unbalanced while traveling. In particular, even when the direction in which the main body 100*a* or 100*b* is manually dragged is suddenly changed, balance is maintained due to the caster 191.

In some implementations, the caster 191 can be located at a position that is closer to the front side of the main body 100*a* or 100*b* than the rotating shaft 135 of the driving motor 130. The rotating shaft of the caster 191 may be supported by the case 110 and may be arranged parallel to the rotating shaft 135 of the driving motor 130.

What is claimed is:

1. A cleaner comprising:

a main body that is configured to generate suction force;

a suction assembly that is configured to receive and guide dust to the main body; and a coupling hose that couples the suction assembly to the main body, wherein the main body includes:

an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a motor cover that is configured to cover the driving motor such that the driving motor is located in a space between the first surface of the case and the motor cover, a rotating shaft that is coupled to the driving motor and that is configured to transfer driving force generated by the driving motor to the traveling wheel, and a coupling unit that couples the rotating shaft to the traveling wheel, wherein the motor cover includes:

a first plate that faces the traveling wheel and that includes a shaft hole through which the rotating shaft passes, a partition wall that couples the first plate to the first surface of the case, and a coupling mount that protrudes from the partition wall and that is fixed to the first surface of the case by a fastening member.

2. The cleaner of claim 1, wherein the case includes:

a mount-coupling boss that protrudes from the first surface of the case, and wherein the fastening member is configured to (i) pass through the coupling mount and (ii) fix the coupling mount to the mount-coupling boss.

3. The cleaner of claim 1, wherein the main body further includes:

a bearing that is coupled to the driving motor, that is configured to support the rotating shaft, and that is fixed to the first plate of the motor cover, and wherein at least a portion of the bearing is located in the space between the first surface of the case and the motor cover.

4. The cleaner of claim 3, wherein the driving motor includes:

a stator, a bearing coupling plate that includes a first surface that is coupled to the bearing and a second surface that is coupled to the stator, and an outer rotor that is located adjacent to the stator relative to the bearing, that is coupled to the rotating shaft, and that includes permanent magnets arranged on an inner surface of the outer rotor.

5. The cleaner of claim 3, wherein the main body further includes:

a bearing support plate that includes (i) a first surface that is coupled to the bearing to support the bearing and (ii) a second surface that is coupled to the first plate of the motor cover.

6. The cleaner of claim 1, wherein the motor cover further includes:

a rib including a circular-shaped wall that protrudes from the first plate toward the traveling wheel.

7. The cleaner of claim 6, wherein the motor cover further includes:

a plurality of cover-reinforcing ribs that protrude from an outer surface of the circular-shaped wall, that are arranged around the circular-shaped wall, and that are coupled to the first plate.

8. A cleaner comprising:

a main body that is configured to generate suction force;

a suction assembly that is configured to receive and guide dust to the main body; and a coupling hose that couples the suction assembly to the main body, wherein the main body includes:

an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a motor cover that is configured to cover the driving motor such that the driving motor is located in a space between the first surface of the case and the motor cover, a rotating shaft that is coupled to the driving motor and that is configured to transfer driving force generated by the driving motor to the traveling wheel, and a coupling unit that couples the rotating shaft to the traveling wheel, wherein the motor cover includes:

a first plate that faces the traveling wheel and that includes a shaft hole through which the rotating shaft passes, a partition wall that couples the first plate to the first surface of the case, and a plurality of coupling mounts that are arranged symmetrically around the rotating shaft, each of the plurality of coupling mounts (i) protruding from a respective portion of the partition wall and (ii) being fixed to the first surface of the case by a respective fastening member.

9. A cleaner comprising:

a main body that is configured to generate suction force;

a suction assembly that is configured to receive and guide dust to the main body; and a coupling hose that couples the suction assembly to the main body, wherein the main body includes:

an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a motor cover that is configured to cover the driving motor such that the driving motor is located in a space between the first surface of the case and the motor cover, a rotating shaft that is coupled to the driving motor and that is configured to transfer driving force generated by the driving motor to the traveling wheel, and a coupling unit that couples the rotating shaft to the traveling wheel, wherein the coupling unit includes:

a rotating plate that includes a hub that is coupled to the rotating shaft, and a plurality of wheel-coupling bosses that protrude from the rotating plate toward the traveling wheel and that are symmetrically arranged about the hub.

10. The cleaner of claim 9, wherein the traveling wheel includes:

a plurality of fastening holes corresponding to the plurality of wheel-coupling bosses, wherein the plurality of wheel-coupling bosses of the coupling unit are fixed to the traveling wheel by a plurality of fastening members, and wherein each of the plurality of fastening members is configured to (i) pass through the respective fastening hole and (ii) fix the respective wheel-coupling boss to the traveling wheel.

11. A cleaner comprising:

a main body that is configured to generate suction force;

a suction assembly that is configured to receive and guide dust to the main body; and a coupling hose that couples the suction assembly to the main body, wherein the main body includes:

an air suctioning device that is configured to generate suction force, a case that includes an interior space accommodating the air suctioning device, a driving motor that is coupled to a first surface of the case and that is configured to generate driving force, a traveling wheel that is coupled to the first surface of the case and that is configured to rotate based on driving force generated by the driving motor, a rotating shaft that is coupled to the driving motor and that is configured to transfer driving force generated by the driving motor to the traveling wheel, a bearing that is coupled to the driving motor and that is configured to support the rotating shaft, a partition wall that protrudes from a first surface of the case, where the partition wall and the first surface of the case define (i) a space to accommodate the driving motor and (ii) an opening to the space, a bearing support plate that covers the opening to the space and that is coupled to the bearing, where at least a portion of the bearing is located in the space, and a coupling unit that is located between the bearing support plate and the traveling wheel and that couples the rotating shaft to the traveling wheel.

12. The cleaner of claim 11, wherein the case further includes:

a support-plate-coupling boss that protrudes from an outer surface of the partition wall, wherein the bearing support plate includes a fastening hole corresponding to the support-plate-coupling boss, and wherein the bearing support plate is fixed to the support-plate-coupling boss by a fastening member, the fastening member being configured to pass through the fastening hole and fix the bearing support plate to the support-plate-coupling boss.

13. The cleaner of claim 12, wherein the main body further includes:

a tubular-shaped shock-absorbing member that comprises a flexible material and that is located between the support-plate-coupling boss and the bearing support plate, and wherein the fastening member passes through the tubular-shaped shock-absorbing member.

14. The cleaner of claim 11, wherein the case further includes:

a plurality of support-plate-coupling bosses that protrude from an outer surface of the partition wall, wherein the bearing support plate includes a plurality of fastening holes corresponding to the plurality of support-plate-coupling bosses, and wherein the bearing support plate is fixed to the plurality of support-plate-coupling bosses by a plurality of fastening members, each of the plurality of fastening members being configured to pass through the respective fastening hole and fix the bearing support plate to the respective support-plate-coupling boss.

15. The cleaner of claim 11, wherein the traveling wheel includes:

a wheel body that is coupled to the coupling unit, and a ring-shaped shock-absorbing band that comprises a flexible material and that wounds the wheel body.

16. The cleaner of claim 15, wherein the wheel body includes:

a first circular-shaped rib that includes a first surface and a second surface, a plurality of outward radial ribs that are coupled to the first surface of the first circular-shaped rib at first portions of the first surface, and a plurality of inward radial ribs that are coupled to the second surface of the first circular-shaped rib at second portions of the second surface, wherein each of the first portions and each of the second portions are alternately arranged along the first circular-shaped rib, and wherein the first circular-shaped rib, the plurality of outward radial ribs, and the plurality of inward radial ribs protrude from a surface of the wheel body.

17. The cleaner of claim 16, wherein the wheel body further includes:

a second circular-shaped rib that is concentric with the first circular-shaped rib and that has a smaller radius than the first circular-shaped rib, and wherein the plurality of inward radial ribs couple the first circular-shaped rib to the second circular-shaped rib.

18. The cleaner of claim 11, wherein the main body further includes:

a first traveling wheel (i) that is coupled to a second surface of the case, the second surface being located in an opposite side of the first surface of the case and (ii) that is configured to rotate based on driving force generated by the driving motor, and a caster that is located on a third surface of the case, wherein the caster is located between the first surface of the case and the second surface of the case.

19. The cleaner of claim 18, wherein the caster is located closer to a coupling portion between the coupling hose and the main body than the rotating shaft of the driving motor.

* * * * *